US008336711B2

(12) United States Patent
Katsurayama et al.

(10) Patent No.: US 8,336,711 B2
(45) Date of Patent: Dec. 25, 2012

(54) CASE FOR ROLLED OBJECT

(75) Inventors: Mamoru Katsurayama, Ibaraki (JP); Naoyuki Suzuki, Ibaraki (JP); Kozo Ushirobata, Ibaraki (JP); Takeshi Yokomaku, Ibaraki (JP); Akira Sakou, Kasugai (JP)

(73) Assignee: Nitto Denko Corporation, Ibaraki-shi (JP)

( * ) Notice: Subject to any disclaimer, the term of this patent is extended or adjusted under 35 U.S.C. 154(b) by 0 days.

(21) Appl. No.: 13/206,097

(22) Filed: Aug. 9, 2011

(65) Prior Publication Data

US 2012/0031791 A1 Feb. 9, 2012

(30) Foreign Application Priority Data

Aug. 9, 2010 (JP) ..... 2010-178925

(51) Int. Cl.
*B65D 85/67* (2006.01)

(52) U.S. Cl. ..... 206/397; 206/407; 206/408; 206/416

(58) Field of Classification Search ..... 206/389, 206/395–397, 407–409, 416
See application file for complete search history.

(56) References Cited

U.S. PATENT DOCUMENTS

| | | | | |
|---|---|---|---|---|
| 3,291,299 | A * | 12/1966 | Minnotte, Jr | 206/397 |
| 4,122,949 | A | 10/1978 | Blatt | |
| 4,151,914 | A | 5/1979 | Blatt | |
| 4,431,139 | A * | 2/1984 | Barnsbee et al. | 206/395 |
| 4,444,313 | A | 4/1984 | Tyson | |
| 4,724,960 | A * | 2/1988 | Goodrum et al. | 206/397 |
| 4,821,876 | A * | 4/1989 | Naito et al. | 206/395 |
| 5,704,479 | A * | 1/1998 | Barnett et al. | 206/395 |
| 6,805,240 | B2 * | 10/2004 | Smarr et al. | 206/397 |
| 6,896,424 | B2 * | 5/2005 | Hara et al. | 206/397 |
| 6,899,226 | B2 * | 5/2005 | Voissem | 206/397 |
| 2004/0081453 | A1 | 4/2004 | Hara et al. | |

FOREIGN PATENT DOCUMENTS

| | | | |
|---|---|---|---|
| JP | 59-43380 | U | 3/1984 |
| JP | 2001-180657 | A | 7/2001 |
| JP | 2003-252395 | A | 9/2003 |
| JP | 2004-090977 | A | 3/2004 |
| JP | 2004-118110 | A | 4/2004 |
| WO | 2005/030611 | A1 | 4/2005 |

OTHER PUBLICATIONS

European Search Report dated Nov. 30, 2011, issued in corresponding European Patent Application No. 11006519.0.

* cited by examiner

*Primary Examiner* — Bryon Gehman
(74) *Attorney, Agent, or Firm* — Westerman, Hattori, Daniels & Adrian, LLP

(57) ABSTRACT

A rolled object whose core juts from the respective end portions is housed. End face wall components which support the core so as to horizontally suspend the rolled object and side wall components which connect the end face wall components with each other and cause the end face components to be provided on the respective sides of the rolled object in horizontal directions are provided. Each of the side wall components has a vertically-provided planar wall portion and a jutting portion which is formed horizontally across the wall portion at a vertical central portion of the wall portion and juts to be able to surface-contact a circumferential surface of the rolled object.

5 Claims, 16 Drawing Sheets

CASE FOR ROLLED OBJECT

The present application claims priority from Japanese Patent Application No. 2010-178925, which was filed on Aug. 9, 2010, the disclosure of which is herein incorporated by reference in its entirety.

BACKGROUND OF THE INVENTION

1. Field of the Invention

The present invention relates to a case for rolled objects formed by rolling various kinds of sheets.

2. Description of Related Art

When stored and/or transported, rolled objects may be vertically placed with their end faces contacting the mounting surface or horizontally placed with their circumferential surfaces contacting the mounting surface. In these cases, however, disadvantages such as deformation and damage may occur at the part contacting the mounting surface on account of an influence of the load, depending on the material of the sheet. In consideration of this problem, each of Japanese Unexamined Patent Publication No. 2001-180657, Japanese Unexamined Patent Publication No. 2003-252395, Japanese Unexamined Patent Publication No. 2004-90977, and Japanese Unexamined Patent Publication No. 2004-118110 recites a case which is arranged so that the core of a rolled object is arranged to jut from the respective end faces, this core is supported so that the rolled object is suspended in a horizontal position, and such a rolled object is enclosed by planar wall members. Since this case prevents the load from concentrating on a single part of the rolled object, the above-described problems hardly occur even when the rolled object is susceptible to the influence of the load.

However, in the conventional arrangements above, the side wall components covering the circumferential surface of the rolled object are planar. These side wall components are required to be sufficiently thick to achieve the strength with which deformation or buckling is hardly caused by an external force applied to the side wall components during storage or transportation. As a result, the weight and size of the case are increased. Such largeness and heaviness are disadvantageous for storing and transporting rolled objects. Cases are therefore desired to be lightweight and small but have the same degree of strength. In particular, rolled objects tend to be large and heavy these days, and the weight and size of a case must be significantly increased to achieve a strength level necessary for housing a large and heavy rolled object. Much attention has therefore been paid to the weight reduction and downsizing of cases for this reason.

The present invention was done to solve the problem above, and an object of the present invention is to provide a case which is at least lighter than a case constituted by planar wall members but has the same degree of strength as the case constituted by flat wall members.

SUMMARY OF THE INVENTION

A case according to an aspect of the present invention, which houses a rolled object whose core juts from both end portions, includes: end face wall components which support the core so as to horizontally suspend the rolled object; and side wall components which connect the end face wall components with each other and are provided on the respective sides of the rolled object in horizontal directions, each of the side wall components including: a planar wall portion which is vertically disposed; and a jutting portion which is formed horizontally across the wall portion at a vertical central portion of the wall portion and juts to be able to surface-contact a circumferential surface of the rolled object.

According to this arrangement, the core of the rolled object is supported by the end face wall components, the end face wall components are fixed by the weight of the rolled object, and the end face wall components are connected with each other by the side wall components. With this, the rolled object is horizontally suspended and is highly rigidly enclosed by the end face wall components and the side wall components in horizontally directions.

Focusing on the relationship between the side wall components and the end face wall components, a both-end supported beam structure is constructed such that the both end portions of the side wall components are supported by the end face wall components. Each of the side wall components has a planar wall portion provided in the vertical directions and a jutting portion formed on the wall portion, and the jutting portion is formed horizontally across the wall portion at the vertical central portion. The side wall components are arranged so that the jutting portions function as the ribs of the wall portion and hence the second moment of area and the section modulus are increased, with the result that deformation or buckling due to an external force hardly occurs.

Furthermore, even if the side wall components receive a large external force and are deformed in the direction in parallel to the length of the rolled object, excessive deformation is prevented because the jutting portion contacts the circumferential surface of the rolled object and a reaction force to the external force exerted on the side wall components is generated at the position where the rolled object is provided. It is noted that, since the jutting portion surface-contacts the circumferential surface of the rolled object, the load of an external force is distributed as compared to cases where the load is concentrated at one point, and hence the circumferential surface of the rolled object is hardly broken. As such, the advantages including the strength obtained when the side wall components are made of thick flat boards, i.e. the advantages that the deformation or buckling hardly occurs but at the same time the rolled object is not easily damaged are obtained by light-weight side wall components, and hence the weight reduction of the case is achieved.

According to an aspect of the present invention, the jutting portion on each of the side wall components may include: a contact surface which is arranged so that, from the part intersecting with a core horizontal plane which is a plane horizontally cutting the core of the rolled object, an upper region and a lower region of the contact surface are arranged to be inclined away from the wall portion.

According to the arrangement above, when the side wall components are deformed by an external force, the contact surface of the jutting portion contacts the rolled object. In this connection, the contact surface is arranged so that, from the part intersecting with a core horizontal plane, an upper region and a lower region of the contact surface are arranged to be inclined away from the wall portion. Therefore, the contact surface is arranged to be close to the plane extending in the tangential directions of each of the upper and lower regions of the circumferential surface of the rolled object as compared to cases where the contact surface extends in the directions orthogonal to the core horizontal plane. As such, the rolled object is sandwiched and four-point mounted, with the result that the deformation is restrained. With this, it is possible by a simple structure to significantly reduce a possibility that the circumferential surface of the rolled object is damaged.

According to an aspect of the present invention, each of the side wall components may be arranged so that a line connecting vertical ends of the contact surface with each other is closer to the center of the rolled object than the outer circumferential surface of the rolled object.

This makes it possible to downsize the case because the rolled object is stored in the case with its circumferential surface being close to the wall portions of the side wall components.

According to the present invention, each of the side wall components may be constituted by divided structural components which are symmetrically provided in up and down directions about the core horizontal plane, and each of the divided structural components may include: a flat plate portion which is a part of the wall portion; a contact surface portion which is inclined from the edge of the flat plate portion on the core horizontal plane side so as to constitute a part of the contact surface; and a contact surface supporting portion which connects the contact surface portion with the flat plate portion.

According to the arrangement above, since the divided structure component can be easily formed by bending a planar plate member made of cardboard or the like, the side wall component constituted by the divided structure components can also be formed easily. Furthermore, since the side wall component is divided in two at the core horizontal plane in the up and down directions, it is possible to house the rolled object therein in such a way that the rolled object is attached to the end face wall components while only the lower divided structural components are attached, and then the upper divided structural components are attached. In this way, the rolled object is easily housed.

According to an aspect of the present invention, the case may further include a top wall component which is horizontally provided above the rolled object to connect at least the end face wall components with each other; and a bottom wall component which is horizontally provided below the rolled object and connects the end face wall components with each other and connects the side wall components with each other.

According to the arrangement above, it is possible to deal with the top wall component, the bottom wall component, the end face wall components, and the side wall components as individual components of the case, and the rolled object is entirely covered highly rigidly.

According to an aspect of the present invention, the case may further include: an aligning component provided at a predetermined part of the bottom surface of the bottom wall component; and a pallet on which the bottom wall component is mounted, the pallet including: a mounting surface corresponding to the bottom surface of the bottom wall component; and a fitting portion which is formed at the part of the mounting surface where the aligning component is provided, so to be able to fit with the aligning component.

According to this arrangement, since the alignment of the pallet and the bottom wall component is easily done, it is possible to easily construct the case.

According to an aspect of the present invention, it is possible to realize a case storing and housing a rolled heavy object, which case is lighter than a case formed by planar wall members but is possible to restrain the deformation of the rolled object to the same degree as the case formed by planar wall members.

DESCRIPTION OF THE PREFERRED EMBODIMENTS

The following will described a preferred embodiment of the present invention with reference to figures.

(Overall Structure of Case 1)

Figure 1:
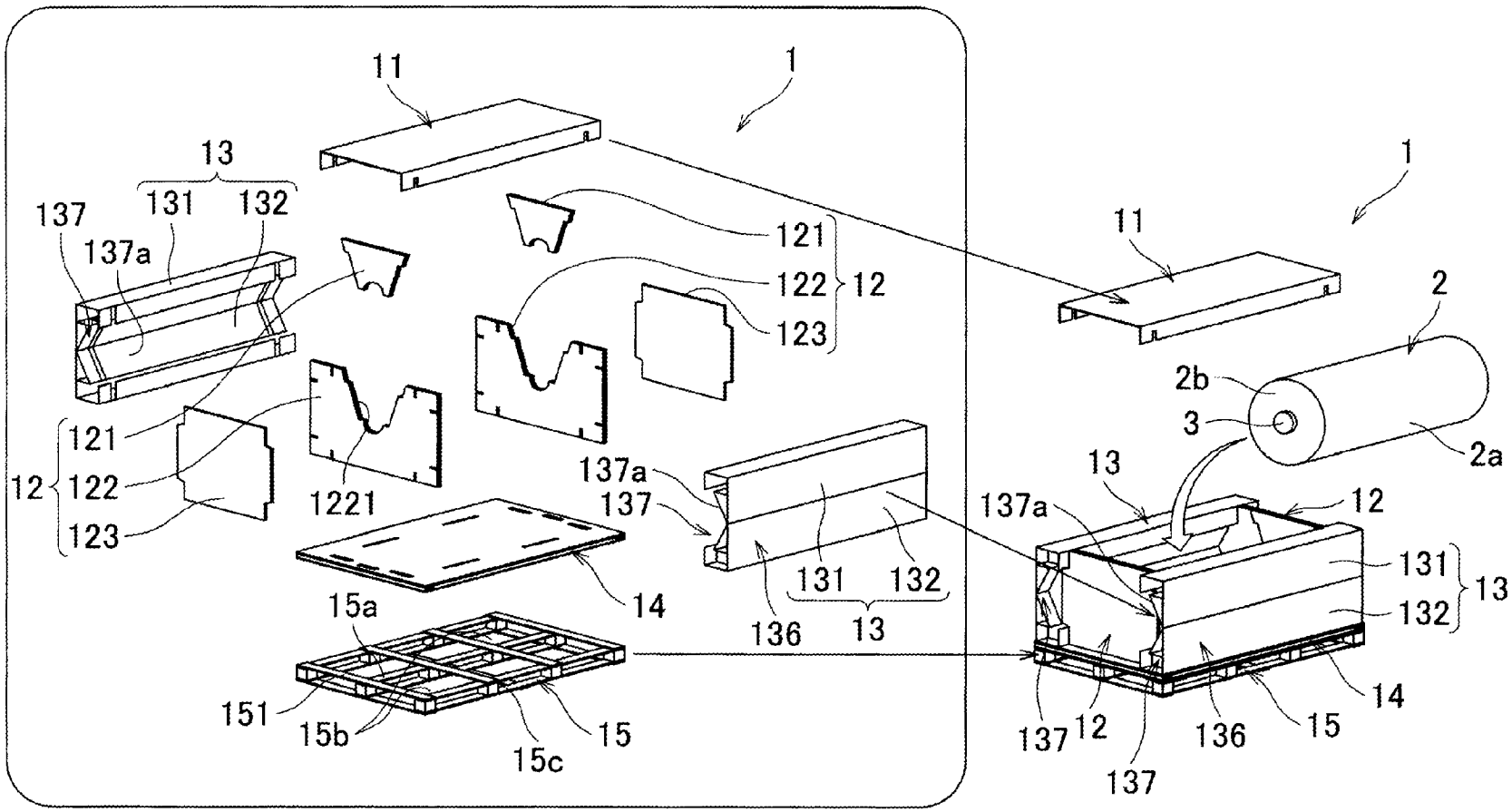
FIG. 1 schematically illustrates a case according to an embodiment of the present invention.

A case 1 of the present embodiment is, as shown in FIG. 1, arranged to house a rolled object 2 whose tube-shaped core 3 juts from the respective end portions so that the rolled object 2 is suspended in a horizontal position. It is noted that, when the rolled object 2 is "suspended", a circumferential surface 2*a* of the rolled object 2 does not contact any surrounding structures. Also, when the rolled object 2 is "in a horizontal position", the core of the rolled object 2 extends in the horizontal directions. This horizontal position may be rephrased as transverse position. The materials, physical properties, and arrangements of the rolled object 2 and the core 3 are not particularly limited.

The case 1 is formed to have a rectangular parallelepiped shape. In the front and back directions of the case 1, end face wall components 12 are symmetrically provided to oppose each other. In the left and right directions of the case 1, side wall components 13 are symmetrically provided to oppose each other. In the up and down directions of the case 1, a top wall component 11 and a bottom wall component 14 are provided to oppose each other. The "front and back directions" are directions along the long sides of the case 1 and in which the end faces oppose each other. The directions are in parallel to the core of the rolled object 2 in the horizontal position. The "left and right directions" are the width directions of the case 1 and are horizontal directions orthogonal to the length of the core of the rolled object 2. The "up and down directions" are the height direction and the depth direction of the case 1 and are vertical directions orthogonal to the length of the core of the rolled object 2.

The end face wall components 12, the side wall components 13, the top wall component 11, and the bottom wall component 14 are arranged to be detachable. The case is formed by connecting and constructing these wall components 12, 13, 11, and 14. The wall components 12, 13, 11, and 14 are cardboards. Each cardboard has a corrugated portion where a sheet-shaped cardboard is corrugated to be a plate having a predetermined thickness and a side face portion which is formed by pasting a sheet-shaped cardboard on the side face of the corrugated portion. Cardboards are used in a single-layer state where the number of cardboards is one or in a stacked state where two or more cardboards are stacked, according to needs. Furthermore, in the following descriptions, the directions in which the ridges of a corrugated portion extend will be denoted as "lengthwise directions" whereas the directions in which the ridges are aligned in row will be denoted as "crosswise directions".

In addition to the above, the case 1 has a metal pallet 15 at the bottom. This pallet 15 may be made of cardboard or resin instead of metal. The pallet 15 is detachably connected to the bottom surface of the bottom wall component 14. The pallet 15 is formed to be supportable by an unillustrated carrier such as a fork lift.

(End Face Wall Components 12)

The end face wall components 12 of the case 1 provided to oppose each other in the front and back directions are arranged to support the core 3 to horizontally suspend the rolled object 2. Each of the end face wall components 12 includes a core supporter 122 supporting the lower part of the side face of the core 3, a core fixing member 121 which fixes the core 3 supported by the core supporter 122, and an exterior member 123 which functions as a front or back outer wall of the case 1. Each of the core supporters 122, the core fixing members 121, and the exterior members 123 is formed to be symmetrical about the line which passes through the center of the member and extends in the up and down directions.

(End Face Wall Component 12: Core Supporter 122)

Figure 2:
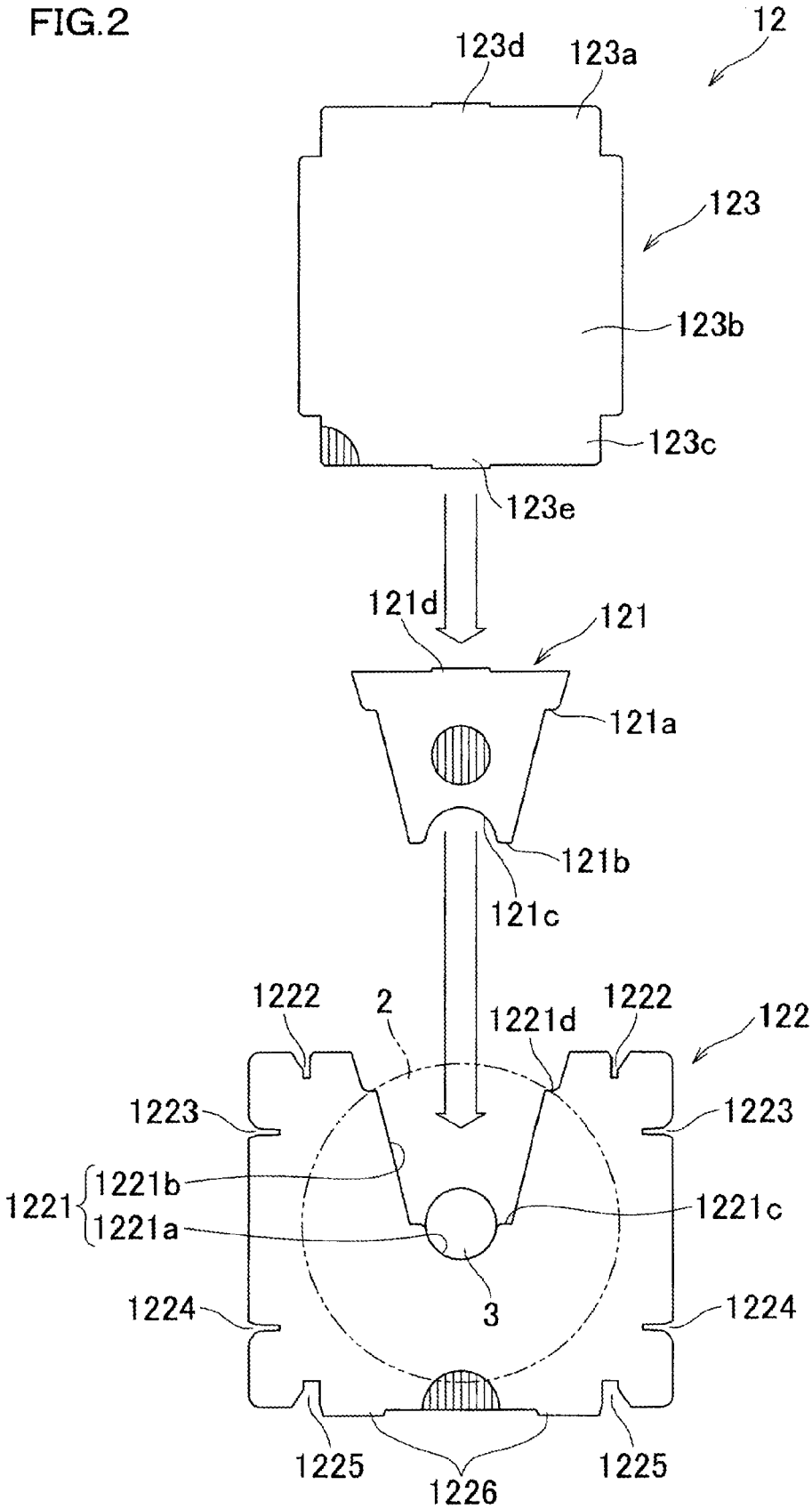
FIG. 2 schematically shows an end face wall component.

Each of the end face wall components 12 is, as shown in FIG. 2, a substantially square flat plate made of cardboard. The core supporter 122 is formed so that the lengthwise directions of the cardboard are in parallel to the up and down directions of the case 1. The core supporter 122 has a core supporting portion 1221 by which the core 3 is supported. This core supporting portion 1221 is formed by cutting off the core supporter 122 from its upper end to the central part.

The core supporting portion 1221 has a lower part supporting portion 1221*a* at the central part of the core supporter 122 and an upper fitting portion 1221*b* at the upper part of the lower part supporting portion 1221*a*. The lower part supporting portion 1221*a* is formed to surface-contact the lower part of the circumferential surface of the core 3. More specifically, the lower part supporting portion 1221*a* is formed to be a semi-circle bulging downward. With this arrangement, when the tube-shaped core 3 is placed, the lower part supporting portion 1221*a* extensibly supports the core 3 and positions the core 3 at the central part of the core supporter 122.

Above the lower part supporting portion 1221*a*, the upper fitting portion 1221*b* is formed. This upper fitting portion 1221*b* is formed to extend from the upper end of the core supporter 122 to the lower part supporting portion 1221*a*. The upper fitting portion 1221*b* is tapered toward the upper end of the core supporter 122, and its lower end abutting the lower part supporting portion 1221*a* is the narrowest. With this arrangement, the upper fitting portion 1221*b* is capable of guiding the core 3 toward the lower part supporting portion 1221*a* even if the core 3 shakes or there is a positional error when the core 3 is lowered. For the reason above, the core supporting portion 1221 can easily house the rolled object 2 in a short time.

In addition to the above, the upper fitting portion 1221*b* has upper stepped portions 1221*d* and lower stepped portions 1221*c*. The upper stepped portions 1221*d* are close to the upper end of the core supporter 122. The lower stepped portions 1221*c* are at the lower end portion on the lower part supporting portion 1221*a* side. The lower stepped portions 1221*c* and the upper stepped portions 1221*d* support the core fixing member 121 in the up and down directions so as to prevent stress from concentrating on the lower part of the core fixing member 121 (i.e. on the core 3 side of the core fixing member 121).

The core supporter 122 further has first fitting grooves 1222, second fitting grooves 1223, third fitting grooves 1224, and fourth fitting grooves 1225, and also has first jutting portions 1226. The first to fourth fitting grooves 1222 to 1225 and the first jutting portions 1226 are disposed to be symmetrical with one another about the core supporting portion 1221.

The first fitting grooves 1222 are formed by cutting off parts of the upper end of the core supporter 122. The grooves 1222 connect the top wall component 11, the end face wall components 12 and the upper side face members 131 of the side wall components 13 with one another. The second fitting grooves 1223 are formed at the upper parts of the respective side surfaces of the core supporter 122, to connect the upper side face members 131 of the side wall components 13 with the end face wall component 12. The third fitting grooves 1224 are formed at the lower parts of the respective side faces of the core supporter 122, to connect the lower side face members 132 of the side wall components 13 with the end face wall component 12.

The fourth fitting grooves 1225 are formed at the bottom surface of the core supporter 122, to connect the lower side face members 132 of the side wall components 13 with the end face wall component 12. Each of these fourth fitting grooves 1225 is arranged to be wider than the other fitting grooves 1222 to 1224 to allow plural layers of cardboards to fit therein. These grooves prevent the case 1 from deforming even if the bottom surface of the case 1 is heavily loaded with the rolled object 2. Between the fourth fitting grooves 1225, first jutting portions 1226 are formed. These first jutting portions 1226 jut from the lower end face of the core supporter 122, for the purpose of aligning the bottom wall component 14 with the end face wall component 12.

(End Face Wall Component 12: Core Fixing Member 121)

In the core supporter 122 arranged as above, the core fixing member 121 is detachably fitted in the core supporting portion 1221. The core fixing member 121 is made of cardboard. The cardboard of which the core fixing member 121 is made is arranged so that its lengthwise directions are in parallel to the up and down directions of the case 1.

The side surfaces of the core fixing member 121 are formed to have the same shapes as the side surfaces of the upper fitting portion 1221*b*. More specifically, the core fixing member 121 is tapered to be narrowed in width from the upper end face toward the lower end face. Furthermore, the core fixing member 121 has upper stepped portions 121*a* and lower stepped portions 121*b*. The upper stepped portions 121*a* are formed at the upper parts of the core fixing member 121. The lower stepped portions 121*b* are formed at the lower end face of the core fixing member 121. These upper stepped portions 121*a* and the lower stepped portions 121*b* are arranged and formed to contact the upper stepped portions 1221*d* and the lower stepped portions 1221*c* of the core supporter 122, respectively, when the core fixing member 121 is fitted with the core supporting portion 1221 of the core supporter 122.

At the center of the lower end face of the core fixing member 121, an upper surface supporter 121*c* is formed. This upper surface supporter 121*c* is arranged to surface-contact the upper part of the circumferential surface of the core 3. More specifically, the upper surface supporter 121*c* is formed to be a semi-circle bulging upward. With this, the upper surface supporter 121*c* supports, with the lower part supporting portion 1221*a* of the core supporter 122, the entire circumference of the tube-shaped core 3. That is to say, the core fixing member 121 and the core supporter 122 are arranged to detachably fix the core 3 to the central portion of the end face wall component 12.

The upper end face of the core fixing member 121 is arranged to correspond to the upper end face of the core supporter 122, when the core fixing member 121 is fitted with the supporting portion 1221 of the core supporter 122. Furthermore, at the central portion of the upper end face of the core fixing member 121, a jutting portion 121*d* is formed. This jutting portion 121*d* juts from the upper end face of the core supporter 122 for the purpose of aligning the top wall component 11 with the end face wall component 12.

(End Face Wall Component 12: Exterior Member 123)

At the front and back of the core supporter 122 and the core fixing member 121 above, exterior members 123 are detachably provided. The exterior member 123 includes an upper end region 123*a* on the upper side, a central region 123*b* at the central part, and a lower end region 123*c* on the lower side. The upper end region 123*a* and the lower end region 123*c* are arranged to have short widths. On the other hand, the central region 123*b* is arranged to have a long width.

More specifically, the width of the exterior member 123 is two-stepped in the left and right directions, i.e. the short width and the long width. The long width of the central region 123*b* is substantially as long as the distance between the central portions of the side wall components 13 connected to the core supporter 122. The short widths of the upper end region 123*a* and the lower end region 123*c* are substantially as long as the distance between the upper (or lower) portions of the side wall components 13 connected to the core supporter 122. This arrangement allows the exterior member 123 to be detachable from the case 1 in the front and back directions.

The height of the exterior member 123 is arranged so that its upper and lower end faces correspond to the upper and lower end faces of the core supporter 122. On the upper and lower end faces of the exterior member 123, an upper jutting portion 123*d* and a lower jutting portion 123*e* are formed, respectively. The upper jutting portion 123*d* juts from the upper end face of the exterior member 123 for the purpose of aligning the top wall component 11 with the end face wall component 12. On the other hand, the lower jutting portion 123*e* juts from the lower end face of the exterior member 123 for the purpose of aligning the bottom wall component 14 with the end face wall component 12.

(Bottom Wall Component 14)

Below the end face wall components 12 described above, as shown in FIG. 3, the bottom wall component 14 is provided. The bottom wall component 14 is horizontally provided below the rolled object 2, and is arranged to align the end face wall components 12 with each other and align the side wall components 13 with each other.

The bottom wall component 14 is a flat rectangular plate in plan view and is made of cardboard. The bottom wall component 14 is formed so that the lengthwise directions of the cardboard are in parallel to the front and back directions of the case 1, i.e. in parallel to the length of the core of the rolled object 2. The bottom wall component 14 has first fitting portions 14*a* and second fitting portions 14*b*. These fitting portions 14*a* to 14*b* are symmetrically arranged about the line O which passes through the center point of the bottom wall component 14.

More specifically, the first fitting portions 14*a* are formed at the central parts of the respective ends of the bottom wall component 14, which are the respective ends of the line O. With the first fitting portions 14*a*, the lower jutting portions 123*e* of the respective exterior members 123 are fitted, so that the exterior members 123 are detachably connected to the bottom wall component 14. The second fitting portions 14*b* are symmetrically formed on the respective sides of each of the first fitting portions 14*a*. With these second fitting portions 14*b*, the first jutting portions 1226 of the core supporters 122 are fitted, so that the core supporters 122 are detachably connected to the bottom wall component 14.

Figure 9:
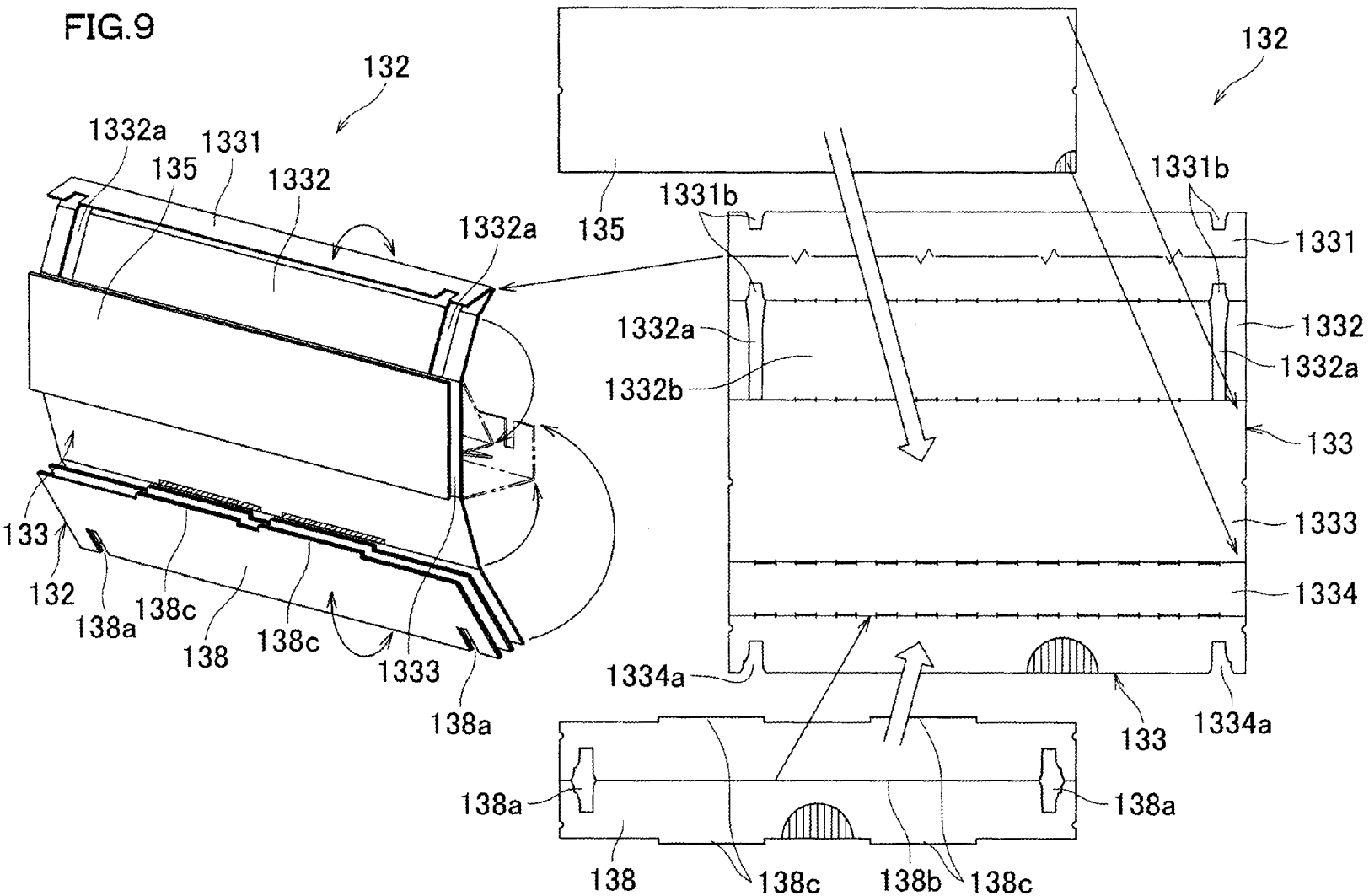
FIG. 9 shows how a lower side face member is constructed.

In addition to the above, the bottom wall component 14 has first through holes 14*c* and second through holes 14*d*. With the first through holes 14*c* and the second through holes 14*d*, jutting portions 138*c* of a reinforcing member 138 shown in FIG. 9 are fitted.

Figure 4:
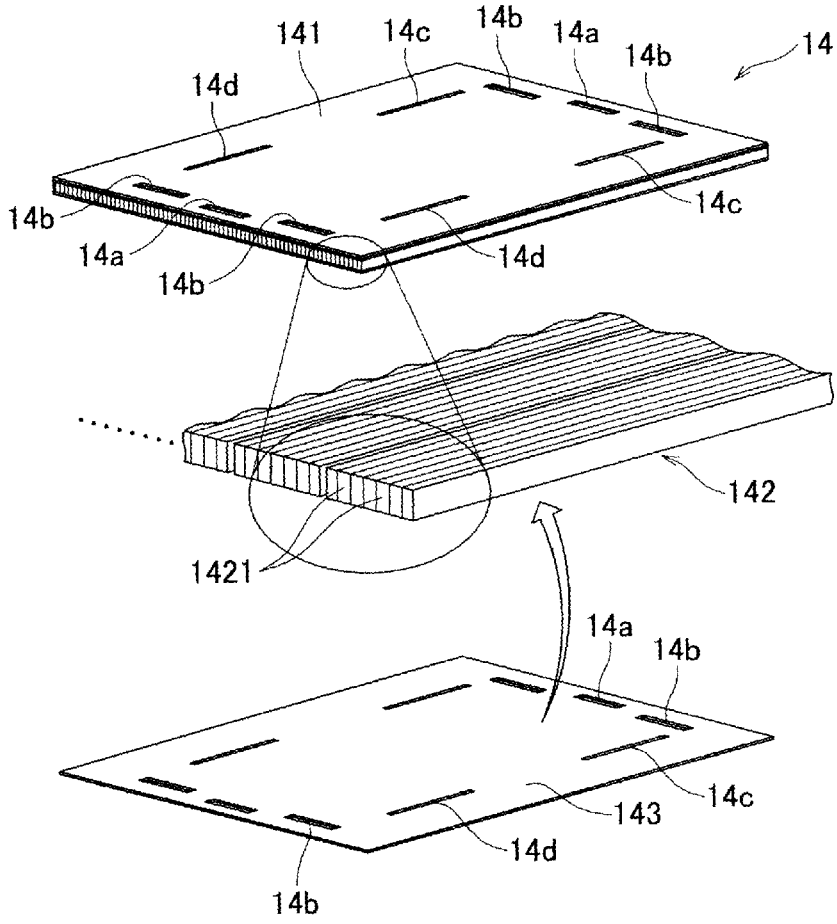
FIG. 4 schematically shows the bottom wall component.
Figure 5:
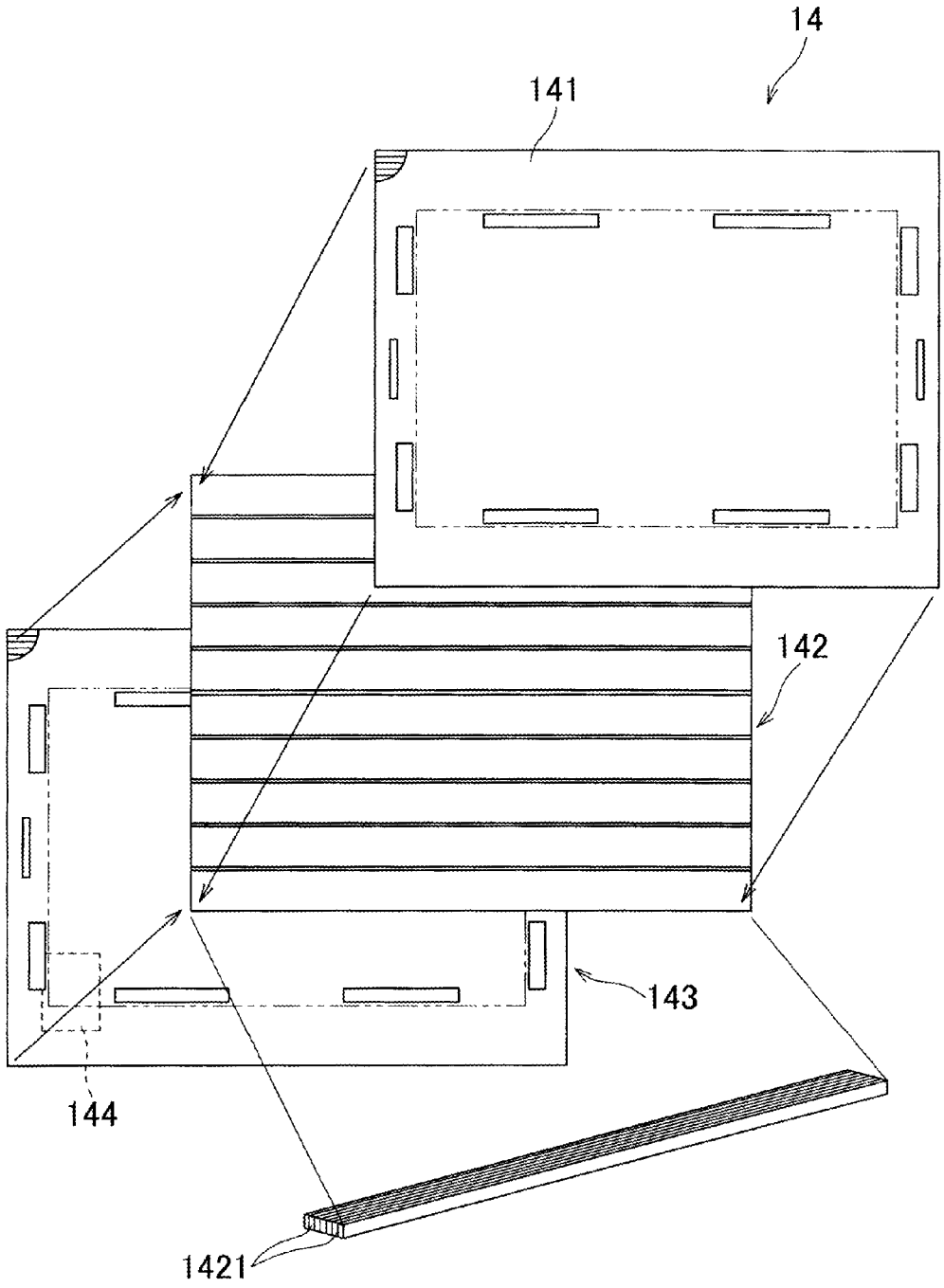
FIG. 5 schematically shows the bottom wall component.

The bottom wall component 14 includes, as shown in FIG. 4 and FIG. 5, a central component 142, an upper flat component 141 pasted to the upper surface of the central component 142, and a lower flat component 143 pasted to the bottom surface of the central component 142. The central component 142 is formed by disposing, in a parallel manner, laminated structures 1421 each formed by laminating rectangular parallelepiped cardboards. The upper flat component 141 and the lower flat component 143 have the same shape and both have the same features such as the first through holes 14*c*. It is noted that the upper flat component 141 and the lower flat component 143 may be differently shaped; the lower flat component 143 may have the same outer shape as the upper flat component but not have the features such as the first through holes 14*c*.

Figure 6:
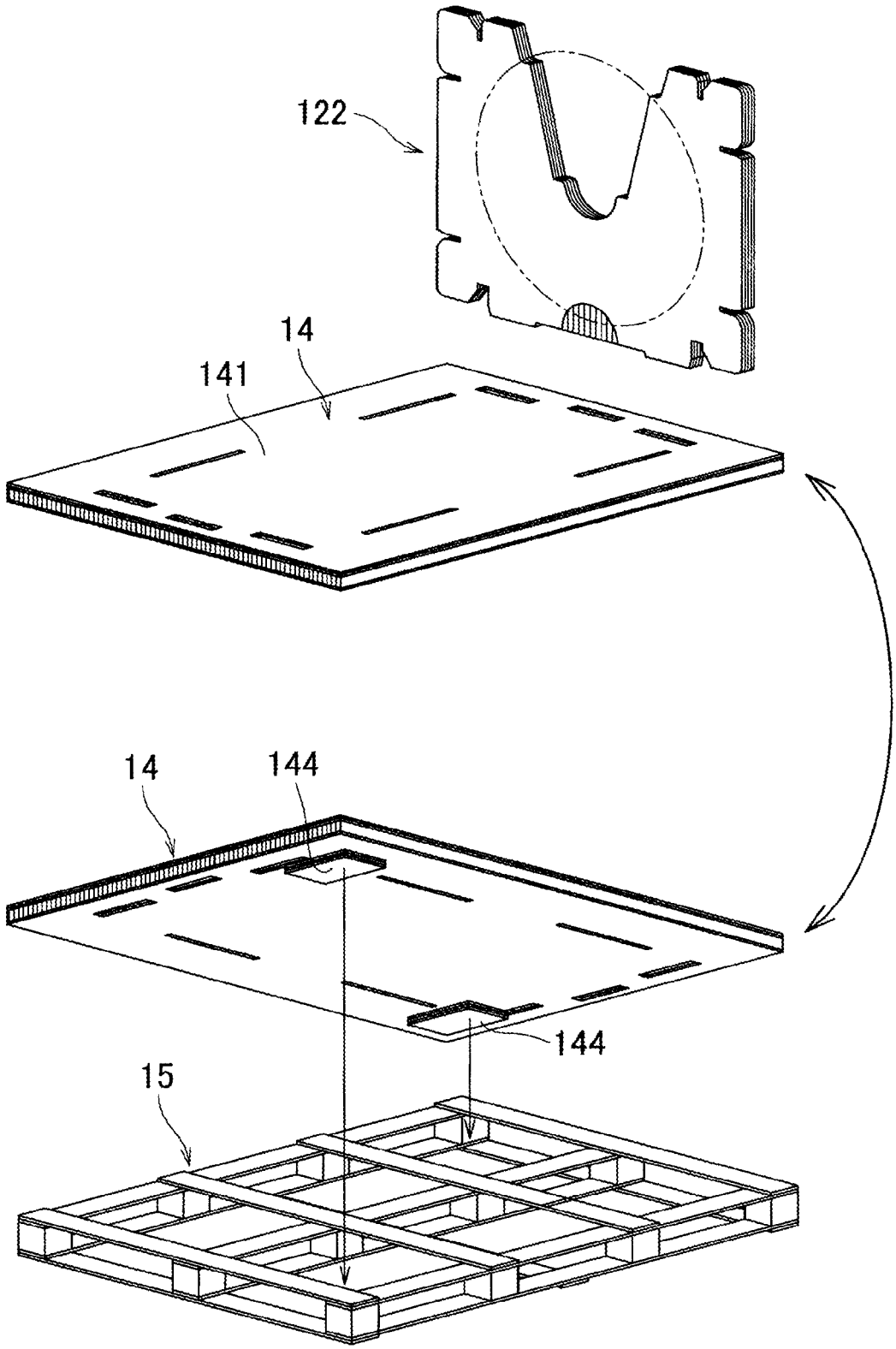
FIG. 6 shows the relationship between the bottom wall component and the pallet.

On the bottom surface of the bottom wall component 14, as shown in FIG. 6, aligning components 144 made of cardboard are provided. These aligning components 144 are arranged to be symmetrical with each other about the center point of the bottom wall component 14. The aligning components 144 are formed and arranged to be able to fit with the gaps formed around the respective corners of the pallet 15, and make it possible to easily align the pallet 15 with the bottom wall component 14 in a short time.

(Side Wall Component 13)

Figure 7:
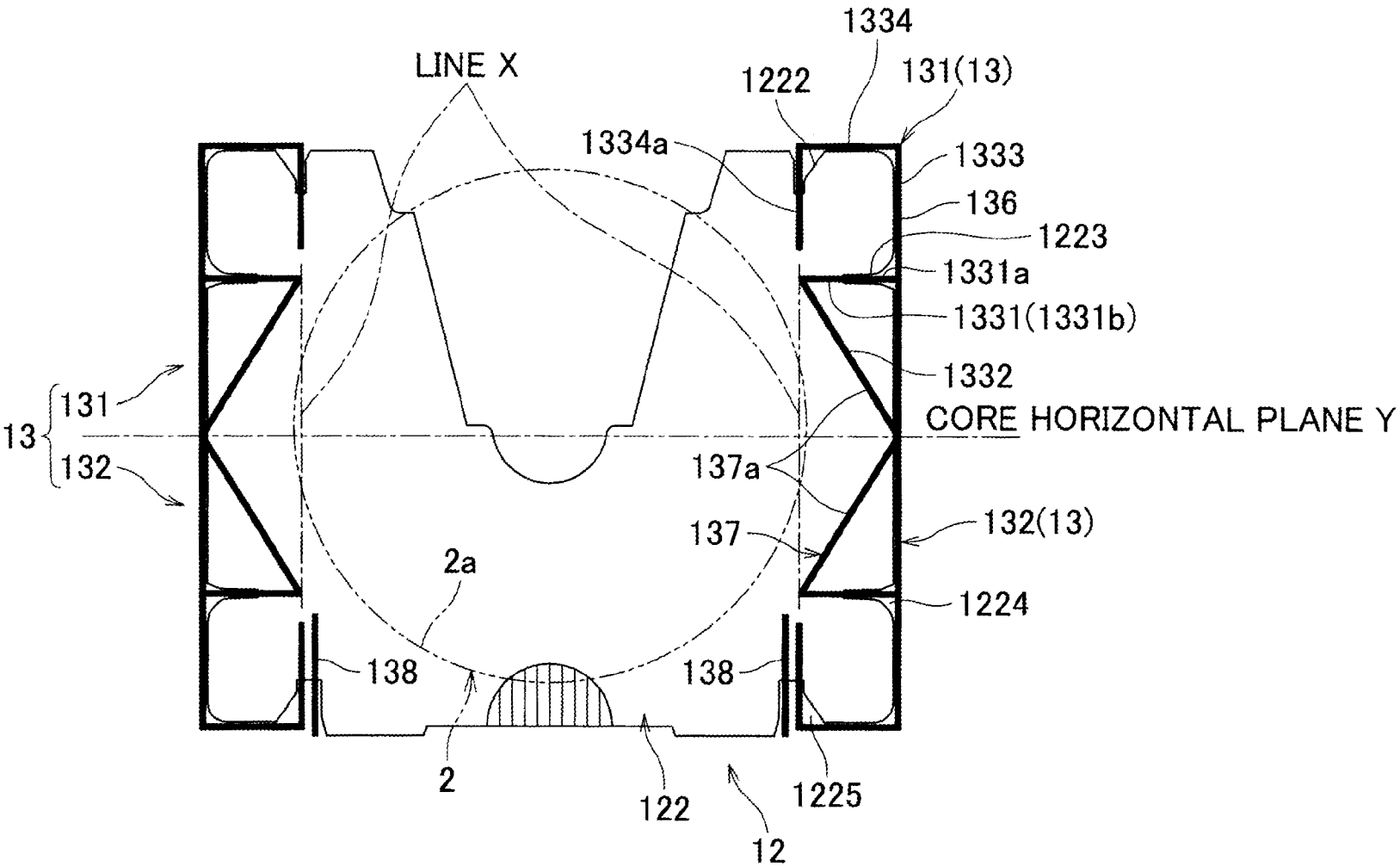
FIG. 7 shows a state that the side wall components are attached to the core supporter.

On the upper surface of the bottom wall component 14, as shown in FIG. 1, the side wall components 13 are provided. The side wall components 13 are arranged to connect the end face wall components 12 with each other and cause these components 12 to be provided on the respective sides of the rolled object 2 in the horizontal directions. Each of the side wall components 13 includes, as shown in FIG. 7, a vertically-provided planar wall portion 136 and a jutting portion 137 which is formed around the vertical center of the wall portion 133 across the entire length of the side wall components 13. The jutting portion 137 juts to be able to surface-contact the circumferential surface 2*a* of the rolled object 2.

The jutting portion 137 has a contact surface 137*a* which opposes the circumferential surface 2*a* of the rolled object 2. The contact surface 137*a* is arranged so that, from the part intersecting with a core horizontal plane Y which is a plane horizontally cutting the core of the rolled object 2, an upper region and a lower region of the contact surface 137*a* are inclined away from the wall portion 136. Alternatively, the contact surface 137*a* may be a straight flat surface or may be concave along the circumferential surface 2*a* of the rolled object 2. Furthermore, the contact surface 137*a* may extend in the vertical directions. The jutting portion 137 having these types of contact surfaces 137*a* may be integrally formed, instead of being divided as in the present embodiment.

In addition to the above, each of the side wall components 13 is arranged so that the line X connecting the vertical ends of the contact surface 137*a* with each other is closer to the center of the rolled object 2 than the circumferential surface 2*a* (outer circumferential surface) of the rolled object 2. This makes it possible to downsize the case 1 because the rolled object 2 is stored in the case 1 with its circumferential surface being close to the wall portions 136 of the side wall components 13.

In addition to the above, each of the side wall components 13 is constituted by two divided structural components (the upper side face member 131 and the lower side face member 132) which are symmetrical with each other in the up and down directions about the core horizontal plane Y. Alternatively, each of the side wall components 13 may be constituted by a single structural component. Each of the divided structural component has a flat plate portion (wall region 1333 and outer plate 135) functioning as a part of the wall portion 136, a contact surface portion (inclined surface region 1332) which is inclined from the edge of the flat plate portion on the core horizontal plane Y side so as to constitute a part of the contact surface 137*a*, and a contact surface supporting portion (central supporting region 1331) which connects the contact surface portion with the flat plate portion.

The divided structure component can be formed by bending a planar plate member made of cardboard or the like, and therefore the divided structure component can be easily formed and the side wall component 13 constituted by the divided structure components can also be formed easily. Furthermore, since the side wall component is divided in two at the core horizontal plane Y in the up and down directions, it is possible to house the rolled object 2 therein in such a way that the rolled object 2 is attached to the end face wall components 12 while only the lower divided structural components are attached, and then the upper divided structural components are attached. In this way, the rolled object 2 is easily housed.

More specifically, each side wall component 13 includes the upper side face member 131 on the upper side of the case 1 and the lower side face member 132 on the lower side of the case 1, in a detachable manner. The upper side face member 131 and the lower side face member 132 are arranged so that their leading ends contact each other at the center of the case 1 in the up and down directions. Furthermore, the upper side face member 131 and the lower side face member 132 are made of cardboard. These upper side face member 131 and the lower side face member 132 are arranged so that the lengthwise directions of the cardboard are in parallel to the up and down directions of the case 1.

(Side Wall Component 13: Upper Side Face Member 131)

Figure 8:
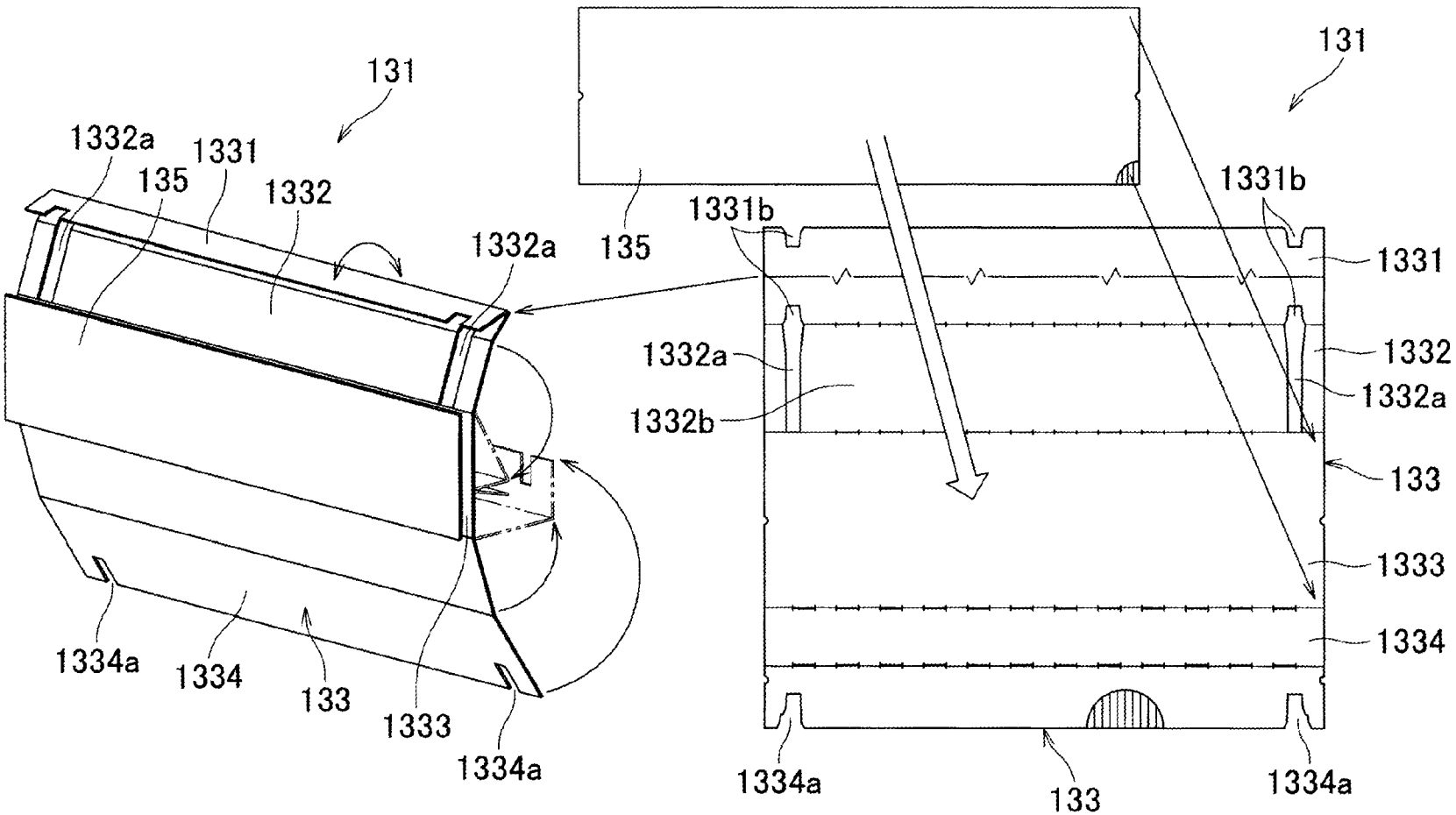
FIG. 8 shows how an upper side face member is constructed.

The upper side face member 131 has, as shown in FIG. 8, a wall member 133. The wall member 133 is rectangular in plan view when exploded, and the length of its longitudinal side is identical with the length of the case 1 in the front and back directions. The wall member 133 is divided into a central supporting region 1331, an inclined surface region 1332, a wall region 1333, and an end face supporting region 1334. These regions 1331 to 1334 are rectangular and provided in this order in the width direction of the wall member 133, i.e., in the direction from the top to the bottom of the case 1. The central supporting region 1331 is at an edge of the wall member 133 in the width directions. The central supporting region 1331 has a folding line 1331*a* at the central part in the width directions. On this folding line 1331*a*, notches are formed along the longitudinal directions at regular intervals. With this, the central supporting region 1331 is foldable for 180 degrees along the folding line 1331*a*.

In addition to the above, around the four corners of the central supporting region 1331, fitting grooves 1331*b* are formed, respectively. The fitting grooves 1331*b* are arranged to be able to fit with the second fitting grooves 1223 of the core supporters 122. When the wall member 133 is folded to be a three-dimensional structure to be fitted with the case 1, the central supporting region 1331 is arranged so that the folding line 1331*a* is a straight ridge which contacts the entirety of the inner wall of the wall region 1333 in the longitudinal directions (i.e. the front and back directions of the case 1). Furthermore, when the fitting grooves 1331*b* are fitted with the second fitting grooves 1223 of the core supporter 122, the central supporting region 1331 is arranged so that its end portions in the longitudinal directions, where the fitting grooves 1331*b* are formed, are supported by the core supporters 122.

To be adjacent to the central supporting region 1331 in the width directions, an inclined surface region 1332 is provided. The inclined surface region 1332 is foldable with respect to the central supporting region 1331 and has insert holes 1332*a* at the end portions in the longitudinal directions. These insert holes 1332*a* are able to receive the core supporters 122, and hence the both end portions of the region 1332 are supported by the end faces of the core supporters 122. Furthermore, the inclined surface region 1332 has an inclined portion 1332*b* between the insert holes 1332*a*, which allows surface-contact with the circumferential surface 2*a* of the rolled object 2.

To be adjacent to the inclined surface region 1332 in the width directions, a wall region 1333 is provided. This wall region 1333 is arranged to be foldable with respect to the inclined surface region 1332, and functions as an outer side wall surface when the case 1 is constructed. To the outer surface of the wall region 1333 (i.e. the outer surface of the case 1), an outer plate 135 is pasted. The outer plate 135 is made of cardboard and has a rectangular shape corresponding to the size and shape of the wall region 1333.

In addition to the above, the end face supporting region 1334 is provided to be adjacent to the wall region 1333. This end face supporting region 1334 is arranged to be foldable with respect to the wall region 1333 and also foldable at the central portion in the width directions. At an edge the end face supporting region 1334 in the width directions, the fitting grooves 1334*a* are formed. The fitting grooves 1334*a* are arranged to be able to fit with the first fitting grooves 1222 of the core supporters 122.

In the meanwhile, as shown in FIG. 9, the lower side face member 132 provided below the upper side face member 131 has a reinforcing member 138 in addition to the wall member 133 and the outer plate 135 which are identical with those of the upper side face member 131. The reinforcing member 138 is a planar rectangular plate when exploded. This reinforcing member 138 has a folding line 138*b* at the central part in the width directions. On this folding line 138*b*, notches are formed along the longitudinal directions at regular intervals. This allows the reinforcing member 138 to be easily folded for 180 degrees at the folding line 138*b*. Furthermore, at the respective longitudinal end portions of the reinforcing member 138, fitting holes 138*a* are formed. These fitting holes 138*a* are arranged to be able to fit with the fourth fitting grooves 1225 of the core supporters 122. The reinforcing member 138 has, furthermore, four jutting portions 138*c* on the end faces in the width directions. These jutting portions 138*c* are arranged to be fitted with the first through holes 14*c* and the second through holes 14*d* of the bottom wall component 14 shown in FIG. 3.

(Top Wall Component 11)

As shown in FIG. 1, the case 1 has the top wall component 11 in a detachable manner. The top wall component 11 is horizontally provided above the circumferential surface 2*a* to connect at least the end face wall components 12 with each other. With this arrangement, in the same manner as the bottom wall component 14, the end face wall components 12, and the side wall components 13, the top wall component 11 functions as an individual component of the case 1 as it is detachable to the case 1, and at the same time is able to rigidly protect the entirety of the rolled object 2 together with the other components.

Figure 10:
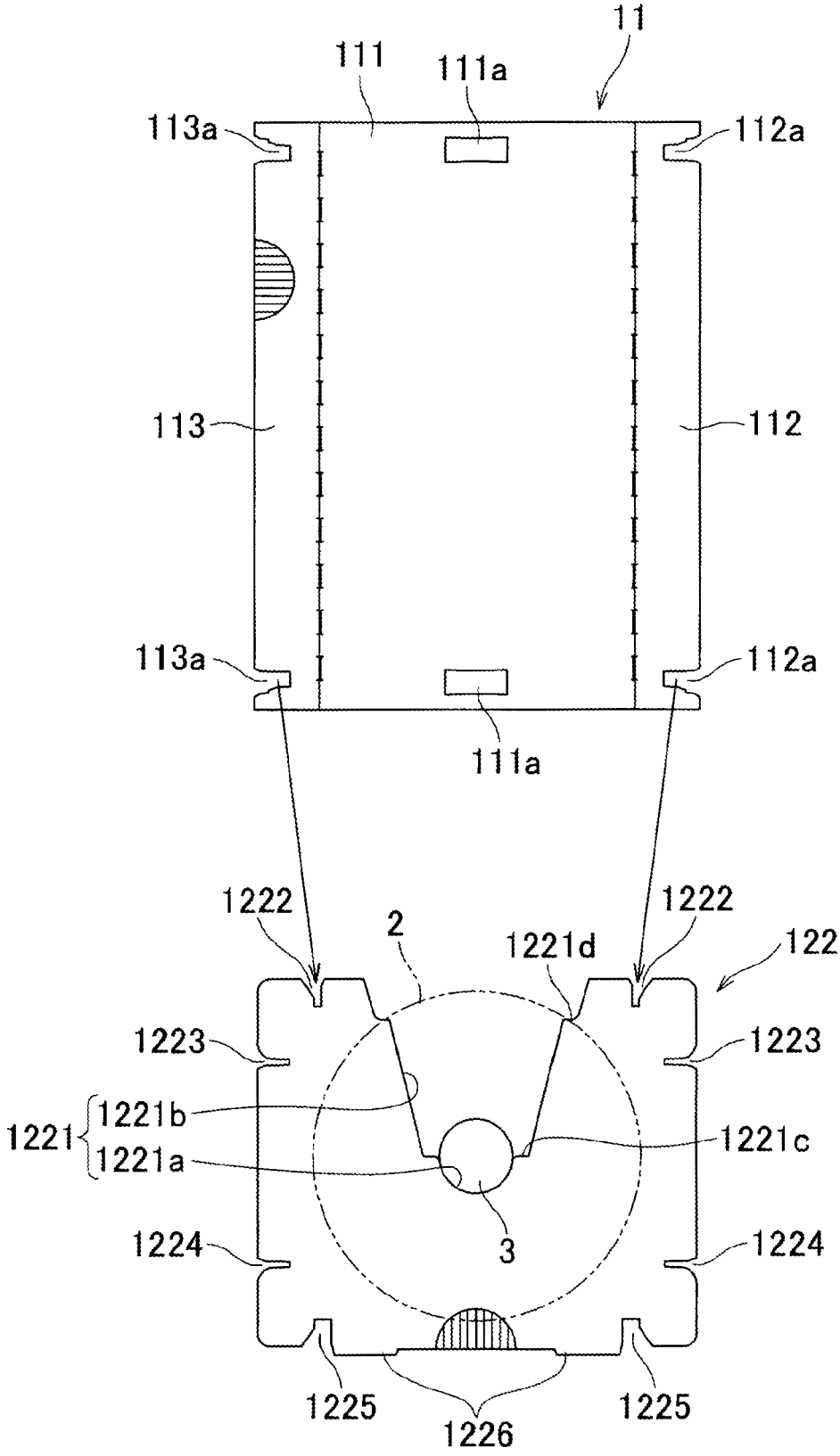
FIG. 10 shows the relationship between the top wall component and a core supporter.

To be more specific, the top wall component 11 is made of cardboard. This top wall component 11 is arranged so that the lengthwise directions of the cardboard are in parallel to the left and right directions of the case 1. As shown in FIG. 10, the top wall component 11 is rectangular in plan view when exploded, and its longitudinal length is identical with the length of the case 1 in the front and back directions.

The top wall component 11 is divided into a top plate region 111 and end face regions 112 and 113. Each of these regions 111, 112, and 113 has a rectangular shape, and the end face regions 112 and 113 are provided on the respective sides of the case 1 in the width directions of the top plate region 111, i.e. the respective sides in the left and right directions. At the longitudinal end portions of the top plate region 111 (i.e. the end portions in the front and back directions of the case 1), fitting holes 111*a* are formed. With these fitting holes 111*a*, the jutting portion 121*d* of the core fixing member 121 and the upper jutting portion 123*d* of the exterior member 123 shown in FIG. 2 are fitted.

In addition to the above, the end face regions 112 and 113 are arranged to be foldable for 90 degrees with respect to the top plate region 111. Furthermore, the end face regions 112 and 113 are provided with fitting grooves 112*a* and 113*a* at the longitudinal end portions. With these fitting grooves 112*a* and 113*a*, the first fitting grooves 1222 of the core supporter 122 are fitted.

(Pallet 15)

As shown in FIG. 1, the case 1 is detachably provided with the pallet 15 on which the bottom wall component 14 is placed. The pallet 15 has a mounting surface 15*a* corresponding to the bottom surface of the bottom wall component 14 and also has fitting portions 15*b*. The fitting portions 15*b* are disposed to correspond to the positions of the aligning components 144 shown in FIG. 3. The mounting surface 15*a* of the pallet 15 is formed by combining long steel components 151. The fitting portions 15*b* are formed by utilizing the junctions of the steel components 151. The pallet 15 has insertion slots 15*c* on the side faces, thereby allowing forks of a forklift or the like to be inserted therein.

(Method of Constructing Case)

The following will describe a method of constructing the case 1 arranged as described above.

Figure 3:
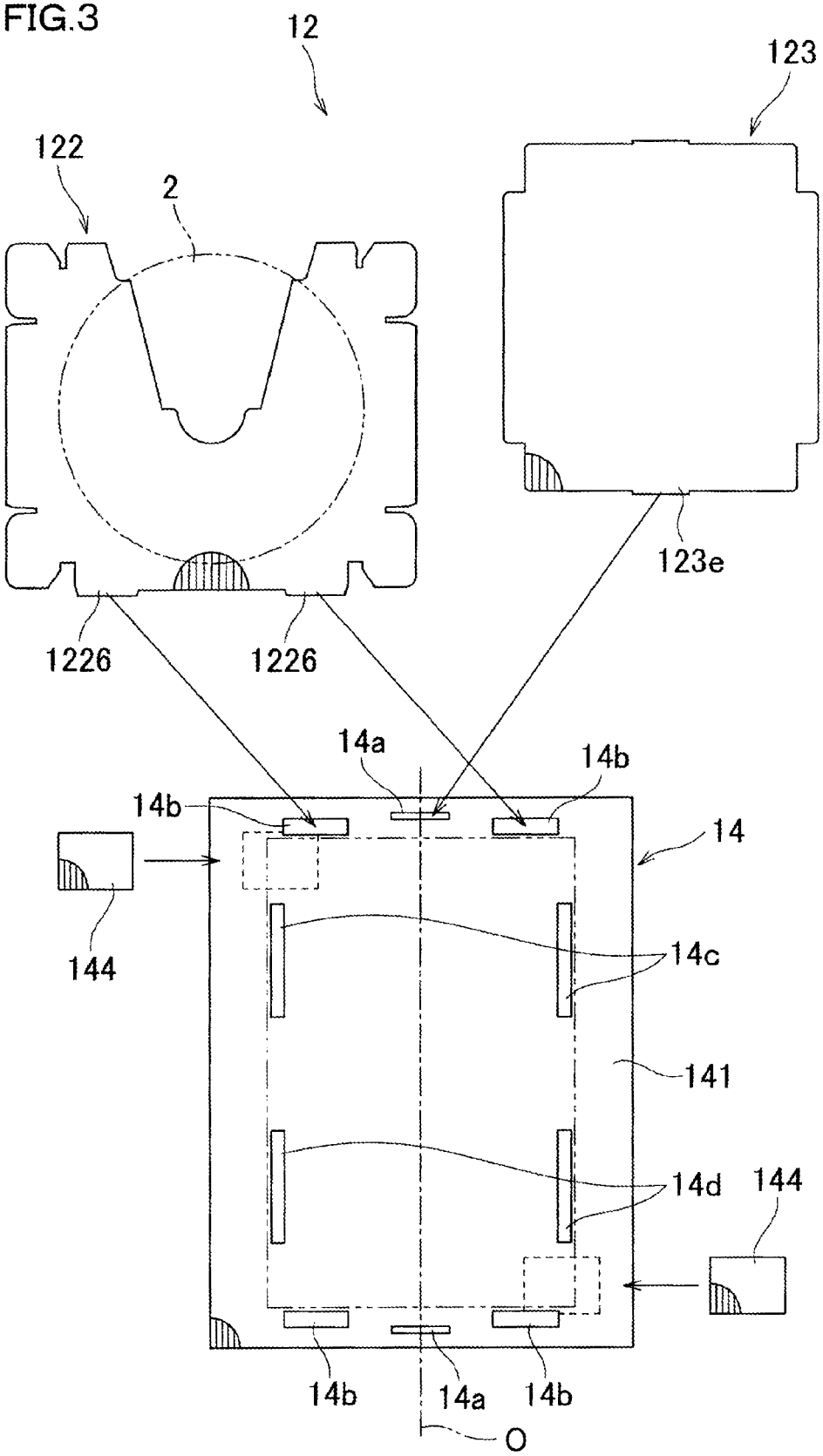
FIG. 3 shows the relationship between the bottom wall component and the end face wall component.
Figure 11:
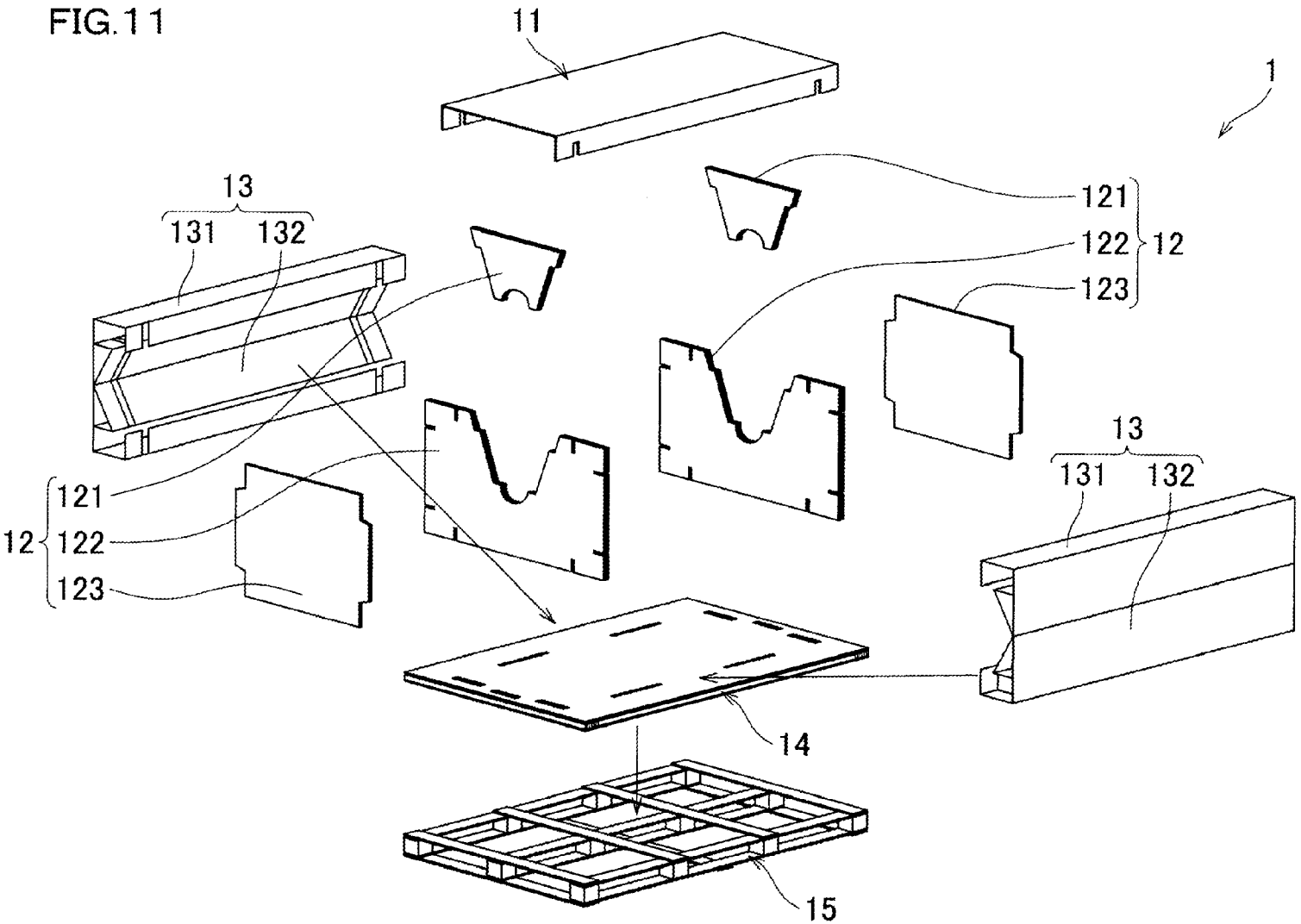
FIG. 11 shows a process of constructing the case.

First, as shown in FIG. 11, the bottom wall component 14 is placed on the pallet 15. In this regard, the aligning components 144 shown in FIG. 3 are provided on the bottom surface of the bottom wall component 14, and these aligning components 144 are fitted with the fitting portions 15*b* of the pallet 15, respectively. With this, the alignment between the pallet 15 and the bottom wall component 14 is easily done.

Thereafter, the side wall components 13 are constructed. More specifically, as shown in FIG. 8, an exploded wall member 133 is prepared. A basic component of the solid object is formed by folding the central supporting region 1331, the inclined surface region 1332, the wall region 1333, and the end face supporting region 1334 of the wall member 133 as indicated by the arrows to form the shape indicated by dotted lines, and the central supporting region 1331 is folded for 180 degrees along the folding line 1331*a*F. Thereafter, the construction of the upper side face member 131 is completed by pasting the outer plate 135 to the wall region 1333 of the structured basic component above. Furthermore, as shown in FIG. 9, the outer plate 135 is pasted onto the wall region 1333 of the structured basic component, and after the reinforcing member 138 is folded along the folding line 138*b*, this member 138 is pasted onto the end face supporting region 1334 of the structured basic component, with the result that the lower side face member 132 is constructed.

Figure 12:
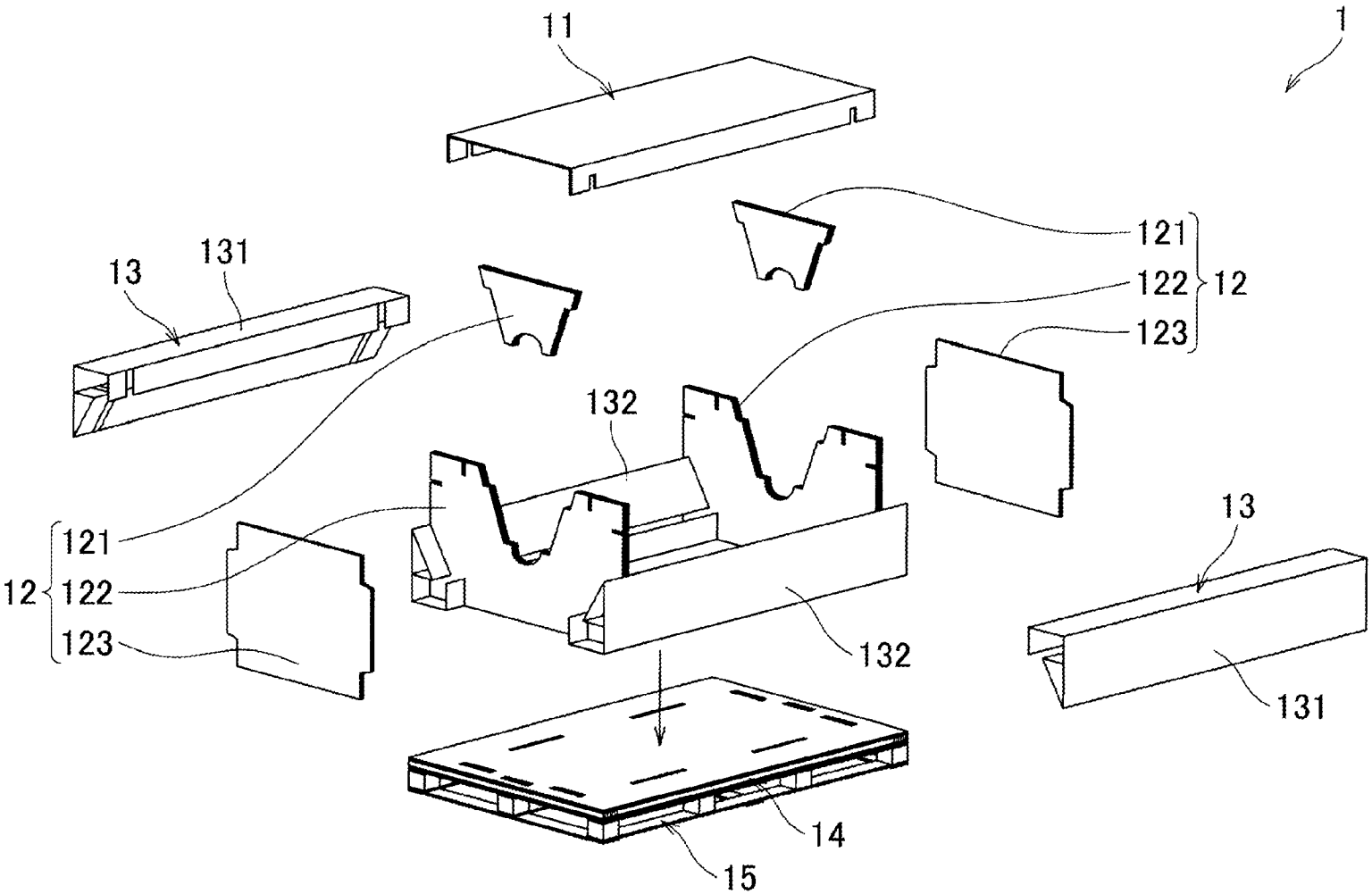
FIG. 12 shows a process of constructing the case.

Subsequently, as shown in FIG. 12, the lower side face members 132 are attached to the core supporters 122. More specifically, as shown in FIG. 7 and FIG. 8, the insert holes 1332*a* pass through the wall portion of the core supporter 122 which portion is above the third fitting grooves 1224, with the result that the central supporting region 1331 is fitted with the third fitting grooves 1224. Furthermore, the fitting grooves 1334*a* of the end face supporting region 1334 are fitted with the fourth fitting grooves 1225 of the core supporter 122.

Figure 13:
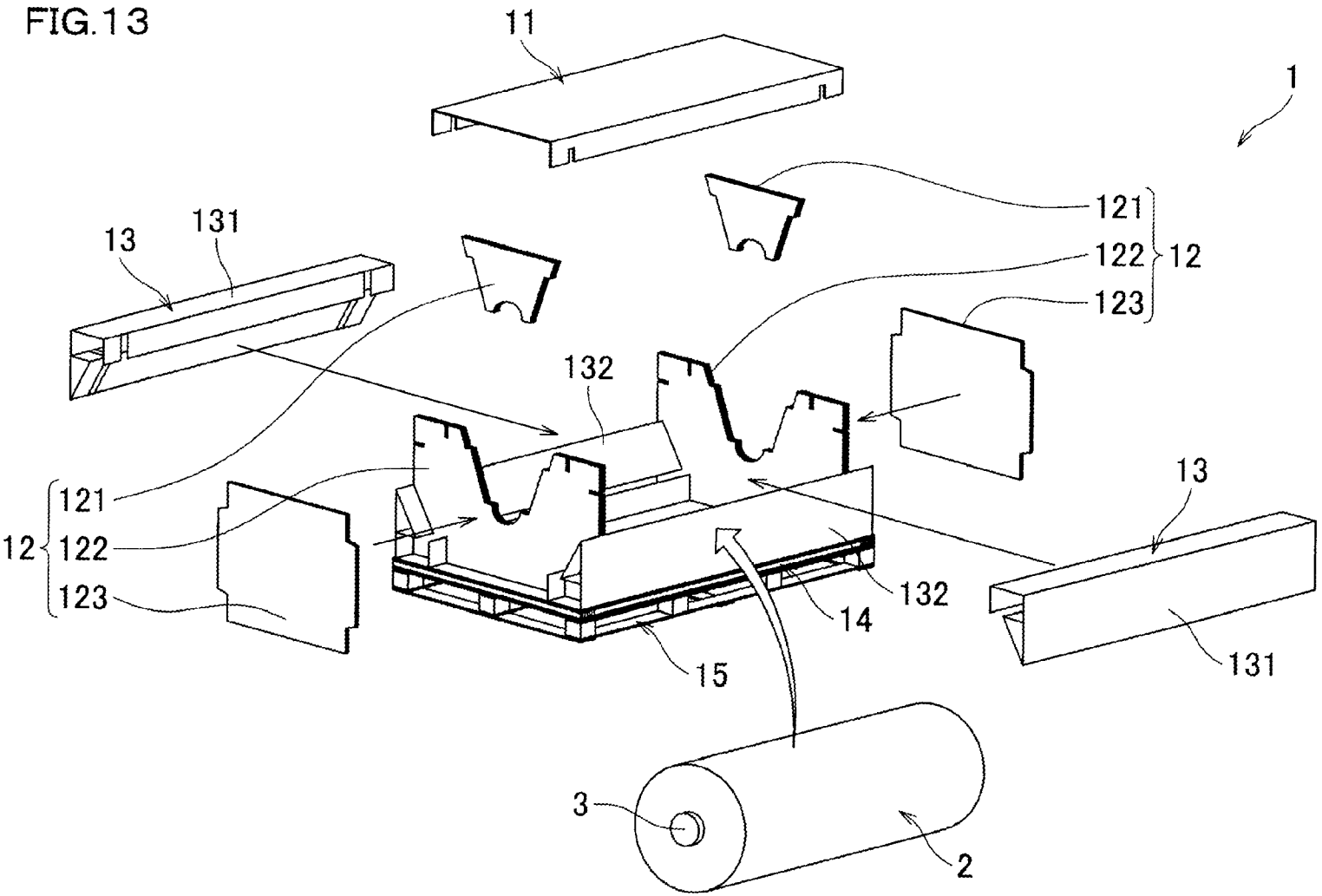
FIG. 13 shows a process of constructing the case.
Figure 14:
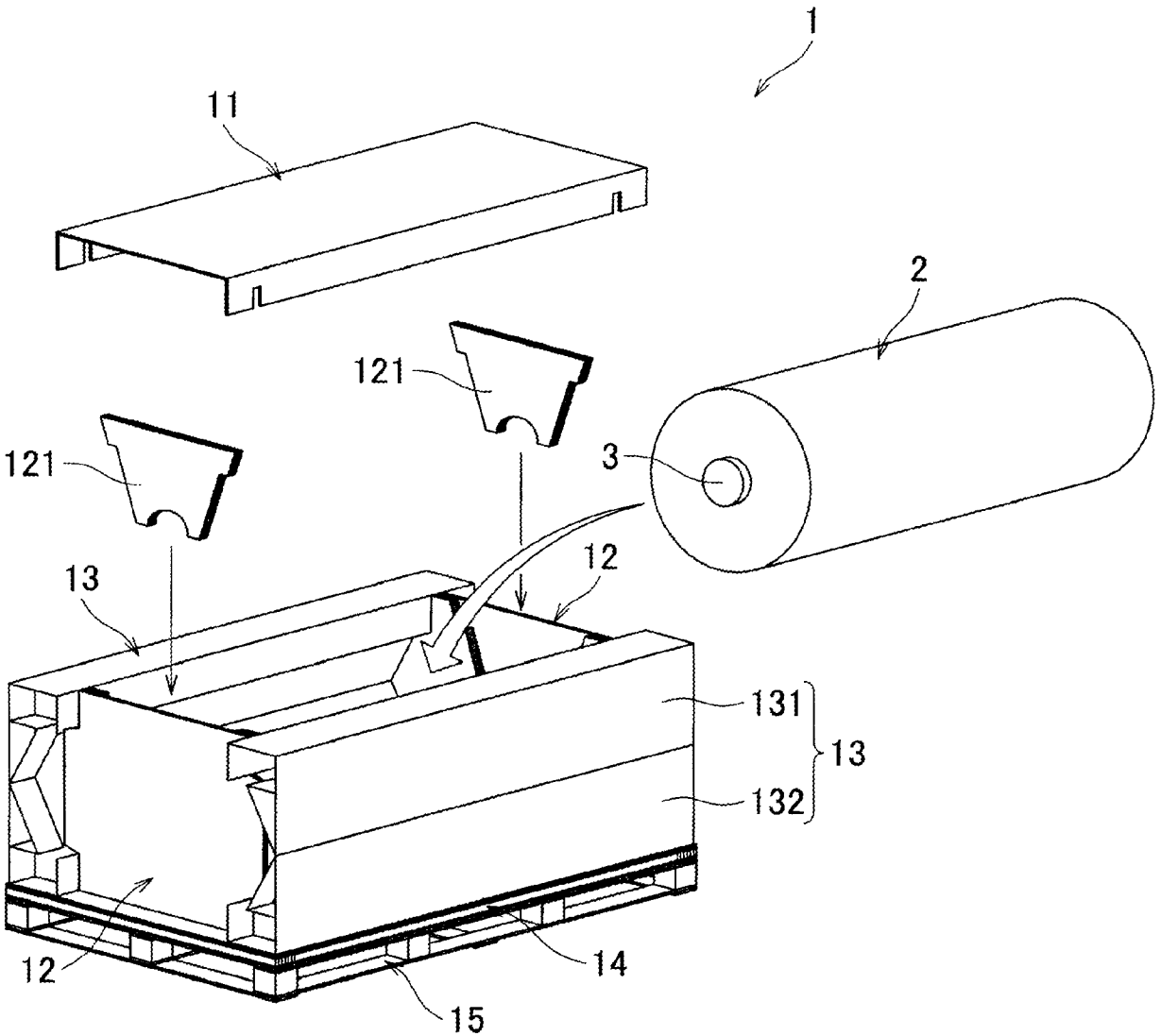
FIG. 14 shows a process of constructing the case.

Subsequently, as shown in FIG. 13, the core supporters 122 and the lower side face members 132 having been integrated are attached to the upper surface of the bottom wall component 14. With this, the constructed case 1 is in an open-top state. Thereafter, after the rolled object 2 is moved while being suspended by an unillustrated transporter and reaches above the case 1, the core 3 of the rolled object 2 is moved down to be supported by the core supporters 122. After the exterior members 123 are attached to the core supporters 122, the side face portions 131 are attached to the core supporters 122 and the core fixing members 121 are attached to the core supporters 122. As a result, as shown in FIG. 14, the case 1 houses the rolled object 2 but still in an open-top state.

Figure 15:
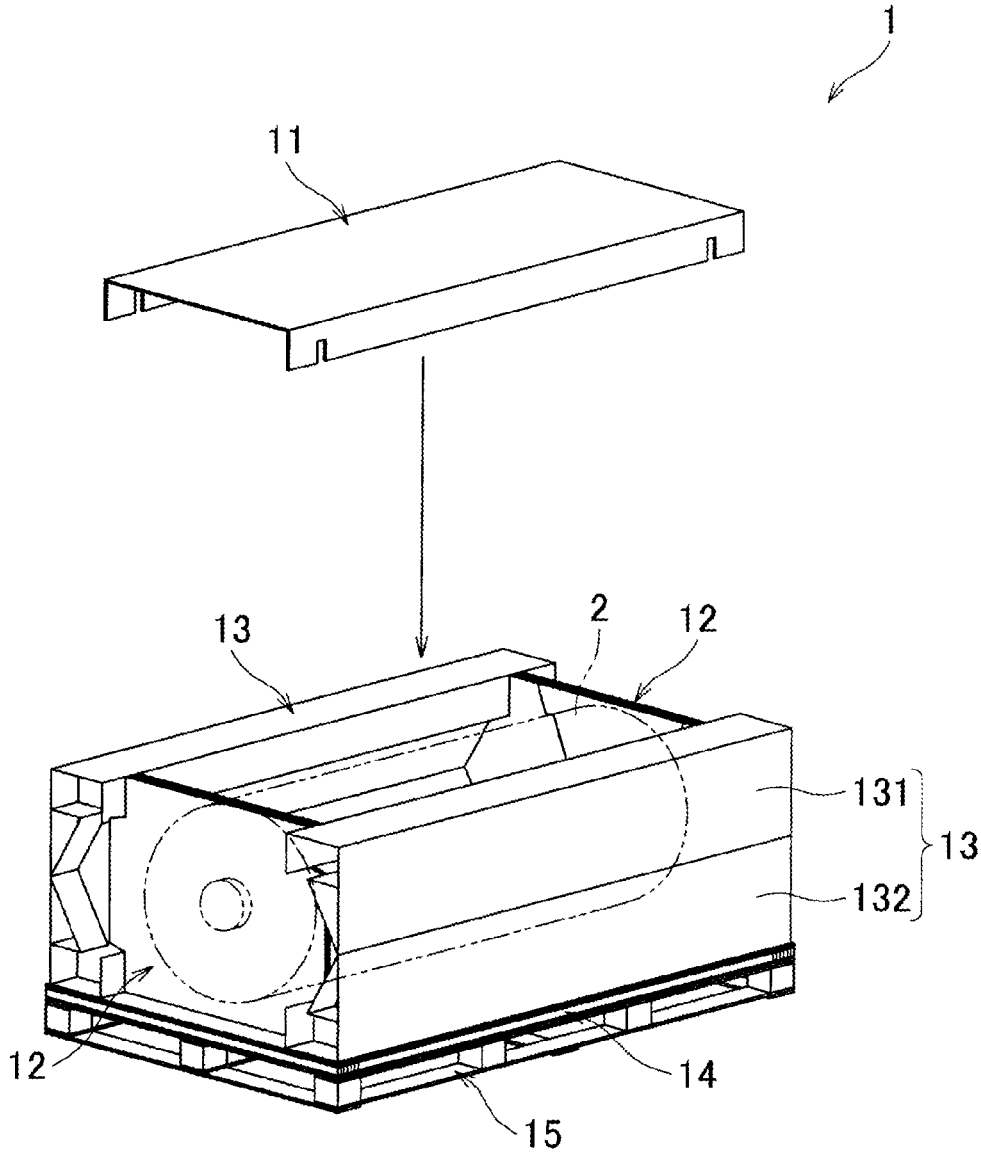
FIG. 15 shows a process of constructing the case.
Figure 16:
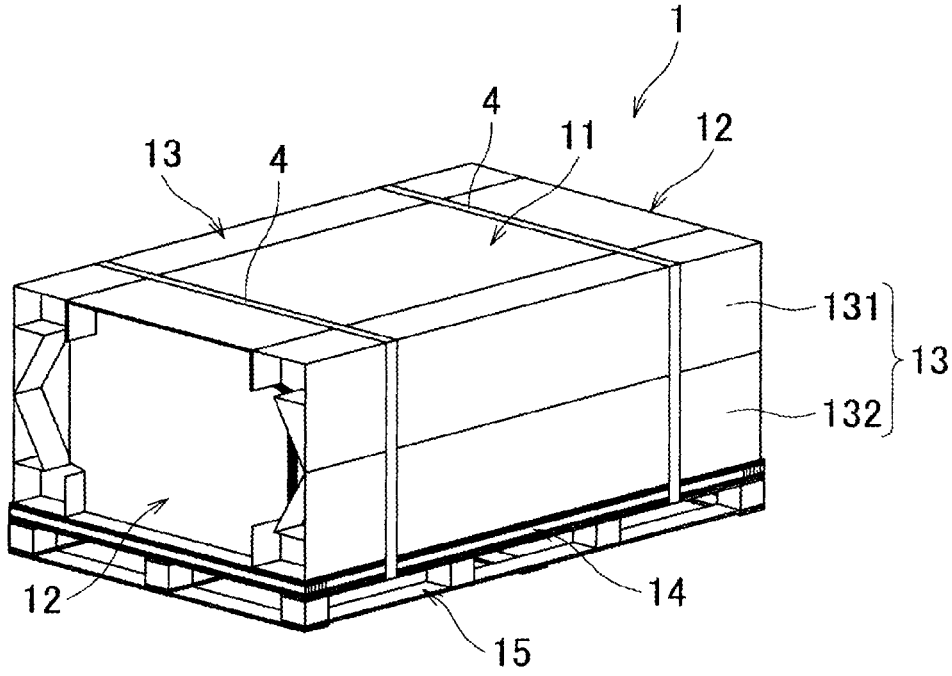
FIG. 16 shows a process of constructing the case.

Subsequently, as shown in FIG. 15, the top wall component 11 is attached to form the upper surface of the case 1, with the result that the rolled object 2 is entirely covered with the cardboards. The housing of the rolled object 2 is completed as the construction of the case 1 is completed, as shown in FIG. 16. Then the case 1 is fastened by binding bands 4, and is transported to a destination and stored.

To take out the rolled object 2 from the case 1, the components such as the end face wall components 12 are detached in the order in reverse to the above, so that the components are dismantled into the pieces before the construction. As such, the case 1 is dismantled into cardboard pieces and the pallet 15 made of steel, after the rolled object 2 is taken out. The cardboard pieces are scrapped or recycled, whereas the pallet 15 is recycled.

(Function of Case)

Now, the function of the case 1 housing the rolled object 2 will be described.

As the rolled object 2 is housed in the case 1, the rolled object 2 is horizontally suspended as the core 3 is supported by the end face wall components 12. As the core 3 is supported by the end face wall components 12, the end face wall components 12 are fixed by the weight of the rolled object 2. Furthermore, as the end face wall components 12 are connected with each other by the side wall components 13, the frame structure constituted by the end face wall components 12 and the side wall components 13 is highly rigid. This frame encloses the rolled object 2 therein in the horizontal directions.

Focusing on the relationship between the side wall components 13 and the end face wall components 12, a both-end supported beam structure is constructed such that the both end portions of the side wall components 13 are supported by the end face wall components 12. Each of the side wall components 13 has a planar wall portion 136 provided in the vertical directions and a jutting portion 137 formed on the wall portion 136, and the jutting portion 137 is formed horizontally across the wall portion 136 at the vertical central portion.

The side wall components 13 are arranged so that the jutting portions 137 function as the ribs of the wall portion 136 and hence the second moment of area and the section modulus are increased, with the result that deformation or buckling due to an external force hardly occurs. Furthermore, even if the side wall components 13 receive a large external force and are deformed in the direction in parallel to the length of the rolled object 2, excessive deformation is prevented because the jutting portion 137 contacts the circumferential surface 2*a* of the rolled object 2 and a reaction force to the external force exerted on the side wall components 13 is generated at the position where the rolled object 2 is provided.

It is noted that, since the jutting portion 137 surface-contacts the circumferential surface 2*a* of the rolled object 2, the load of an external force is distributed as compared to cases where the load is concentrated at one point, and hence the circumferential surface 2*a* of the rolled object 2 is hardly broken. As such, the advantages including the strength obtained when the side wall components 13 are made of thick flat boards, i.e. the advantages that the deformation or buckling hardly occurs but at the same time the rolled object 2 is not easily damaged are obtained by light-weight side wall components 13, and hence the weight reduction of the case 1 is achieved.

In addition to the above, when the side wall components 13 are deformed by an external force, the contact surface 137*a* of the jutting portion 137 contacts the rolled object 2. In this connection, the contact surface 137*a* is arranged so that, from the part intersecting with a core horizontal plane, an upper region and a lower region of the contact surface 137*a* are arranged to be inclined away from the wall portion 136. Therefore, the contact surface 137*a* is arranged to be closer to the plane extending in the tangential directions of each of the upper and lower regions of the circumferential surface of the rolled object 2 than the plane extending in the directions orthogonal to the core horizontal plane. For this reason, the area at which the contact surface 137*a* contacts the circumferential surface 2*a* of the rolled object 2 is large as compared to cases where the contact surface 137*a* is arranged to be orthogonal to the core horizontal plane. With this, it is possible by a simple structure to significantly reduce a possibility that the circumferential surface 2*a* of the rolled object 2 is damaged.

While the present invention has been described in conjunction with the embodiment outlined above, it is evident that many alternatives, modifications and variations will be apparent to those skilled in the art. Accordingly, the effects of the embodiment of the invention as set forth above are merely listed as most favorable effects of the invention, and hence the effects of the invention are not limited to those in the embodiment.

What is claimed is:

1. A case for housing a rolled object which has a core jutting from both end portions of the rolled object, comprising:

end face wall components which support the core so as to horizontally suspend the rolled object; and side wall components which connect the end face wall components with each other and are provided opposite one another along a circumferential surface of the rolled object which when housed is placed in a horizontal direction, each of the side wall components including:

a planar wall portion which is vertically disposed; and a jutting portion which is formed horizontally across the wall portion at a vertical central portion of the wall portion and which has a surface facing when the rolled object is housed, the circumferential surface of the rolled object without being in contact with the circumferential surface, while the surface of the jutting portion is disposed so as to be able to contact the circumferential surface of the rolled object when the case is deformed by an external force, wherein a plane defined by the surface of the jutting portion on each of the side wall components defines an intersection with a core horizontal plane which includes the axis of the core of the rolled object when housed, the surface including an upper region surface and a lower region surface each of which is extending from said intersection and is inclined away from the vertically-disposed planar wall portion to face the circumferential surface of the rolled object, wherein each of the side wall components is arranged so that a line connecting a vertical upper end of the upper region surface and a vertical lower end of the lower region surface intersects with the core horizontal plane at a position closer to the center of the rolled object than the outer circumferential surface of the rolled object, wherein each of the side wall components is assembled by separable structural components which are symmetrically provided in up and down directions about the core horizontal plane, and wherein each of the separable structural components is folded in a manner that forms:

a flat plate portion constituting a part of the vertically-disposed planar wall portion;

a surface portion constituting one of the upper region surface and the lower region surface of the jutting portion; and a surface supporting portion which connects the flat plate portion and the surface portion.

2. The case according to claim 1, further comprising: a top wall component which is horizontally provided above the rolled object to connect at least the end face wall components with each other; and a bottom wall component which is horizontally provided below the rolled object and connects the end face wall components with each other and connects the side wall components with each other.

3. The case according to claim 2, further comprising: an aligning component provided at a predetermined part of the bottom surface of the bottom wall component; and a pallet on which the bottom wall component is mounted, the pallet including:

a mounting surface corresponding to the bottom surface of the bottom wall component; and a fitting portion which is formed at the part of the mounting surface where the aligning component is provided, so to be able to fit with the aligning component.

4. The case according to claim 1, wherein each of said end face wall components includes a core supporter which has a core supporting portion and supports a lower side of the core, the core supporter further having first fitting grooves, second fitting grooves, third fitting grooves, fourth fitting grooves, and first jutting portions, wherein said first to fourth fitting grooves and said first jutting portions are disposed to be symmetrical with one another about the core supporting portion.

5. The case according to claim 4, wherein said surface supporting portion has:

a folding line at a central part of the surface supporting portion, the surface supporting portion being foldable for 180 degrees along the folding line;

fifth fitting grooves which are arranged to be able to fit with the second fitting grooves of the core supporter and are formed around four corners of said surface supporting portion; and an end face supporting region which is provided to be adjacent to the flat plate portion and which is arranged to be able to be foldable with respect to the flat plate portion and also foldable at the central position in the width directions, and which has sixth fitting grooves which are arranged to be able to fit with the first fitting grooves of the core supporter and are formed at an edge of the end face supporting region in the width directions.

* * * * *